US007730974B2

(12) United States Patent
Minshull

(10) Patent No.: US 7,730,974 B2
(45) Date of Patent: Jun. 8, 2010

(54) SELF ACTUATING UNDERREAMER

(76) Inventor: Ronald George Minshull, 31 Millcrest Road SW., Calgary, Alberta (CA) T2Y 2K9

( * ) Notice: Subject to any disclaimer, the term of this patent is extended or adjusted under 35 U.S.C. 154(b) by 0 days.

(21) Appl. No.: 12/089,678

(22) PCT Filed: Oct. 10, 2006

(86) PCT No.: PCT/CA2006/001657

§ 371 (c)(1),
(2), (4) Date: Apr. 9, 2008

(87) PCT Pub. No.: WO2007/041838

PCT Pub. Date: Apr. 19, 2007

(65) Prior Publication Data

US 2008/0251294 A1 Oct. 16, 2008

(51) Int. Cl.
*E21B 7/28* (2006.01)

(52) U.S. Cl. ..... 175/292; 175/290; 175/57

(58) Field of Classification Search ..... 175/57, 175/274, 275, 277, 278, 290, 291
See application file for complete search history.

(56) References Cited

U.S. PATENT DOCUMENTS 1,638,337 A * 8/1927 Hutton ..... 175/291
1,997,436 A * 4/1935 Seay ..... 175/290
3,656,564 A * 4/1972 Brown ..... 175/228
4,915,181 A * 4/1990 Labrosse ..... 175/263
5,271,472 A * 12/1993 Leturno ..... 175/107
6,419,033 B1 * 7/2002 Hahn et al. ..... 175/61
6,561,286 B2 * 5/2003 Armell et al. ..... 175/57
6,920,944 B2 * 7/2005 Eppink et al. ..... 175/53
6,929,076 B2 * 8/2005 Fanuel et al. ..... 175/267
7,048,078 B2 * 5/2006 Dewey et al. ..... 175/57

* cited by examiner

*Primary Examiner*—David J Bagnell
*Assistant Examiner*—Elizabeth C Gottlieb
(74) *Attorney, Agent, or Firm*—Smiths IP; Dana Turner-Ryan; Paul Smith

(57) ABSTRACT

An underreamer for well drilling comprises pivotally extendible roller cutters that extend slightly beyond the diameter of the pilot drill bit but are retained in their retracted position by the casing. Upon encountering an obstruction, the underreamer is pushed out of the casing, allowing the outer edges of the cutters to contact the obstruction. Continued downward pressure of the drill stem causes the roller arms to pivot outward to a fully extended position in which the cutters enlarge the hole to a diameter larger than the casing by rotation of the drilling stem. The advance of the casing relative to the underreamer forces the cutters to retract into the casing.

13 Claims, 9 Drawing Sheets

SELF ACTUATING UNDERREAMER

TECHNICAL FIELD OF THE INVENTION

This invention relates to underreamers used in simultaneous drilling and casing operations. More generally, this invention relates to means for enlarging a borehole created by rotary apparatus.

BACKGROUND OF THE INVENTION

In simultaneous drilling and casing operations, a section of casing follows the drill bit into the borehole. Underreamers located upstream of the drill bit and downstream of the end of the casing are used to enlarge the hole when necessary, such as when an obstruction in the formation is encountered. Such underreamers typically rely on springs or hydraulic pressure to actuate the roller cutters from a retracted, inoperative position to an extended, operating position. When they jam, the underreamers are expensive to remove, with the removal process sometimes requiring the withdrawal of the casing and the associated risk of compromising the integrity of the hole.

Examples of a trailing underreamer used in conjunction with a casing are provided in U.S. Pat. No. 6,419,033 to Hahn et al., U.S. Pat. No. 6,920,944.B2 to Eppink et al., U.S. Pat. No. 6,929,076 to Fanuel et al. and U.S. Pat. No. 7,048,078 to Dewey et al.

It is an object of the present invention to provide an underreamer that does not require springs or hydraulic actuation and that provides an effective means to enlarge a hole into which a casing is to be inserted. More generally, it is an object of the invention to provide a means of enlarging a hole past a pipe inserted into the hole and to a larger diameter than the pipe.

Other objects of the invention will be appreciated by reference to the disclosure and claims that follow.

SUMMARY OF THE INVENTION

In one aspect of the invention, an underreamer is provided upstream of a drill bit and downstream of the drilling stem and that, in its inoperative condition, sits within the pipe or casing.

Pivotally extendible roller cutters extend slightly beyond the diameter of the pilot drill bit but are retained in their retracted position by the casing. Upon encountering an obstruction requiring the operation of the underreamer, the operator of the rig causes the underreamer to be pushed out of the casing, allowing the outer edges of the cutters to contact the obstruction. Continued downward pressure of the drill stem causes the roller arms to pivot outward to a fully extended position in which the cutters enlarge the hole to a diameter larger than the casing by rotation of the drilling stem.

Once the obstruction has been cleared, the operator causes the casing to advance relative to the underreamer such that the casing forces the pivot arms to retract into the casing and into the body of the underreamer into their retracted position. If desired, the underreamer can be completely removed by withdrawing it entirely through the inside of the casing.

In another aspect, the underreamer according to the invention is lowered into the casing only once an obstruction has been encountered and is removed from the casing once the obstruction has been overcome.

The invention is used with rotating equipment that installs pipe as it constructs a borehole. The device finds particular application in drilling rigs and other rotating equipment. A device of this type would have application when there is reason to advance or retract a pipe from a formation while a bore hole is being constructed or decommissioned.

In one aspect the invention comprises an underreamer assembly comprising a casing, a drill bit and an underreamer. The underreamer comprises a body securable to the drill stem and at least one cutter that pivots between a retracted position and an extended position. In the retracted position, the cutter is defined within the diameter of the leading end of the casing but outside the effective boring diameter of the drill bit. In the extended position, the cutter extends beyond the diameter of the casing. Movement from the retracted position to the extended position is actuated by extending the cutter out of the casing and urging it against an obstruction. The cutter is retracted by urging the casing back against the cutter.

In another aspect of the invention, the underreamer assembly comprises at least two cutter assemblies comprising at least two cutters, each of the two cutter assemblies being in opposed relation to one another, and comprising a linking guide element in mating relationship with each of the cutter assemblies for constraining the two cutter assemblies to pivot in unison.

In another aspect, the invention comprises an underreamer comprising an upper body portion and a lower body portion having a diameter smaller than the diameter of the upper body. At least one cutter is mounted for movement between a retracted position and an extended position. In the retracted position, the cutter is defined substantially within the upper body diameter but has an overlap portion thereof extending beyond the diameter of the lower body. In the extended position, the cutter extends outside the upper body diameter. Pivotal movement from the retracted position to the extended position is actuated by urging the overlap portion of the cutter downward against an obstruction.

In a further aspect the invention comprises a method of overcoming an obstruction in simultaneous drilling and casing of boreholes using a drill stem, a drill bit and at least one section of casing having leading end diameter. The method comprises using an underreamer having at least one cutter mounted for pivotal movement between a retracted position and an extended position. The underreamer is inserted into the casing and the casing acts to retain the cutter in the retracted position. The underreamer is displaced in the casing toward the obstruction until the cutter exits the casing and is no longer retained by contact with the casing in the retracted position. A drill bit is used to drill a pilot hole in the obstruction and the cutter is urged against the obstruction thereby causing it to pivot to the extended position outside the leading end diameter of the casing. The cutter is then used to ream the pilot hole.

In a related aspect, the cutter is pivoted to the retracted position by moving the casing and the underreamer relative to one another such that the cutter withdraws into the casing and contact between the casing and the cutter urges the cutter into the retracted position.

Other aspects of the invention will be appreciated by reference to the detailed description of the preferred embodiment thereof and to the claims.

BRIEF DESCRIPTION OF THE DRAWINGS

The preferred embodiment of the invention will be described by reference to the drawings in which.

DETAILED DESCRIPTION OF THE PREFERRED AND ALTERNATIVE EMBODIMENTS OF THE INVENTION

Figure 1:
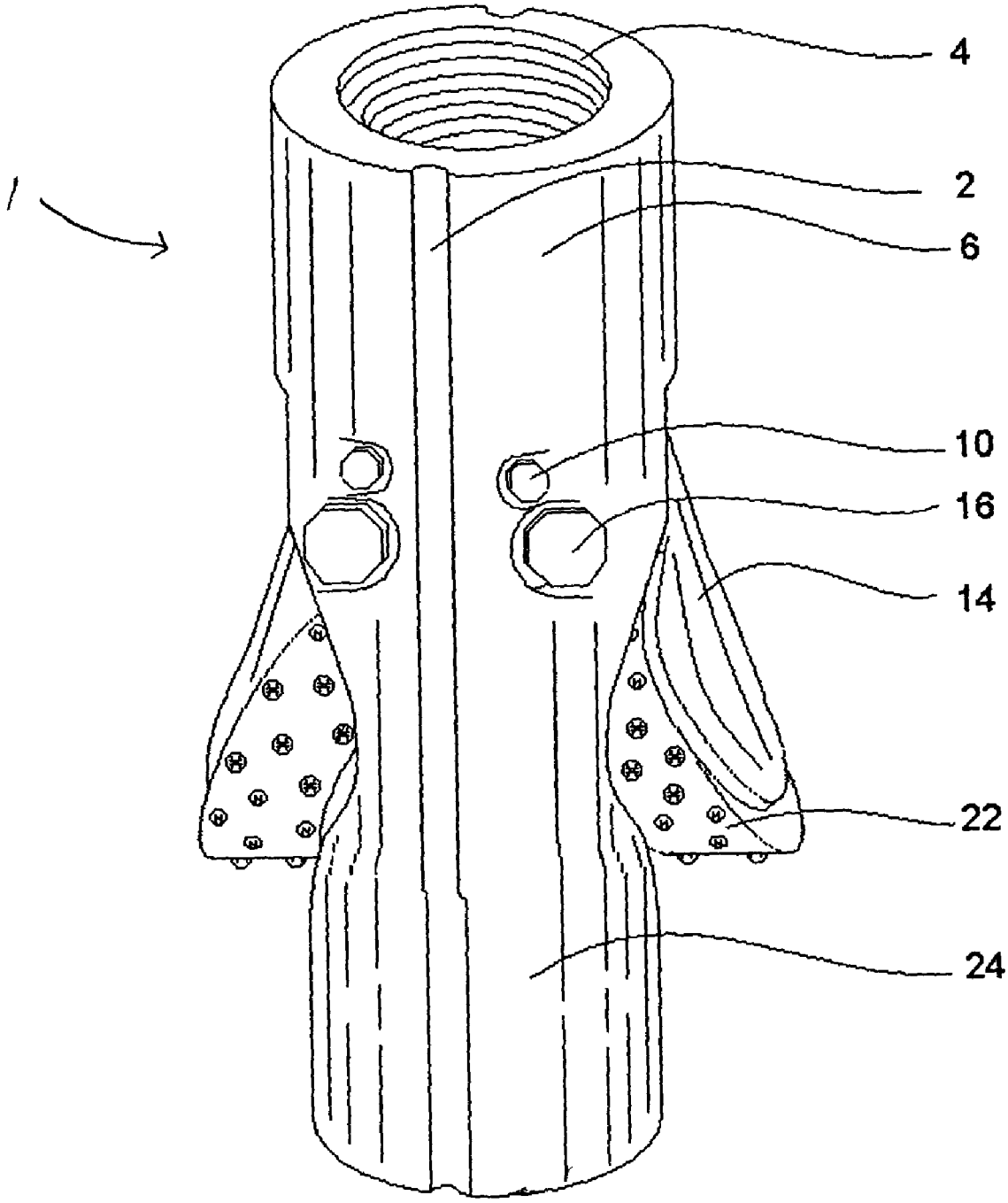
FIG. 1 is a front perspective view of an underreamer according to the preferred embodiment of the invention, with the cone arms in extended position.

Referring to FIG. 1, the underreamer 1 according to the invention comprises an upper stabilizer body portion 6 and a lower stabilizer body portion 24.

Cutters comprise generally cone arms 14 and roller cutters 22. A pair of cone arms 14 are pivotably retained by a pair of swivel pins 16. Stop pins 10 are positioned to limit the outward pivotal displacement of the cone arms 14. Roller cutters 22 are mounted at the ends of cone arms 14. Blade cutters may be substituted for roller cutters 22. The upper end of the upper stabilizer body potion 6 is threaded as at 4 for securing the underreamer to the drill stem (not shown).

The outside of the upper body portion 6 is provided with an upper stabilizer channel 2 for return fluid circulation and cutting removal.

Figure 2:
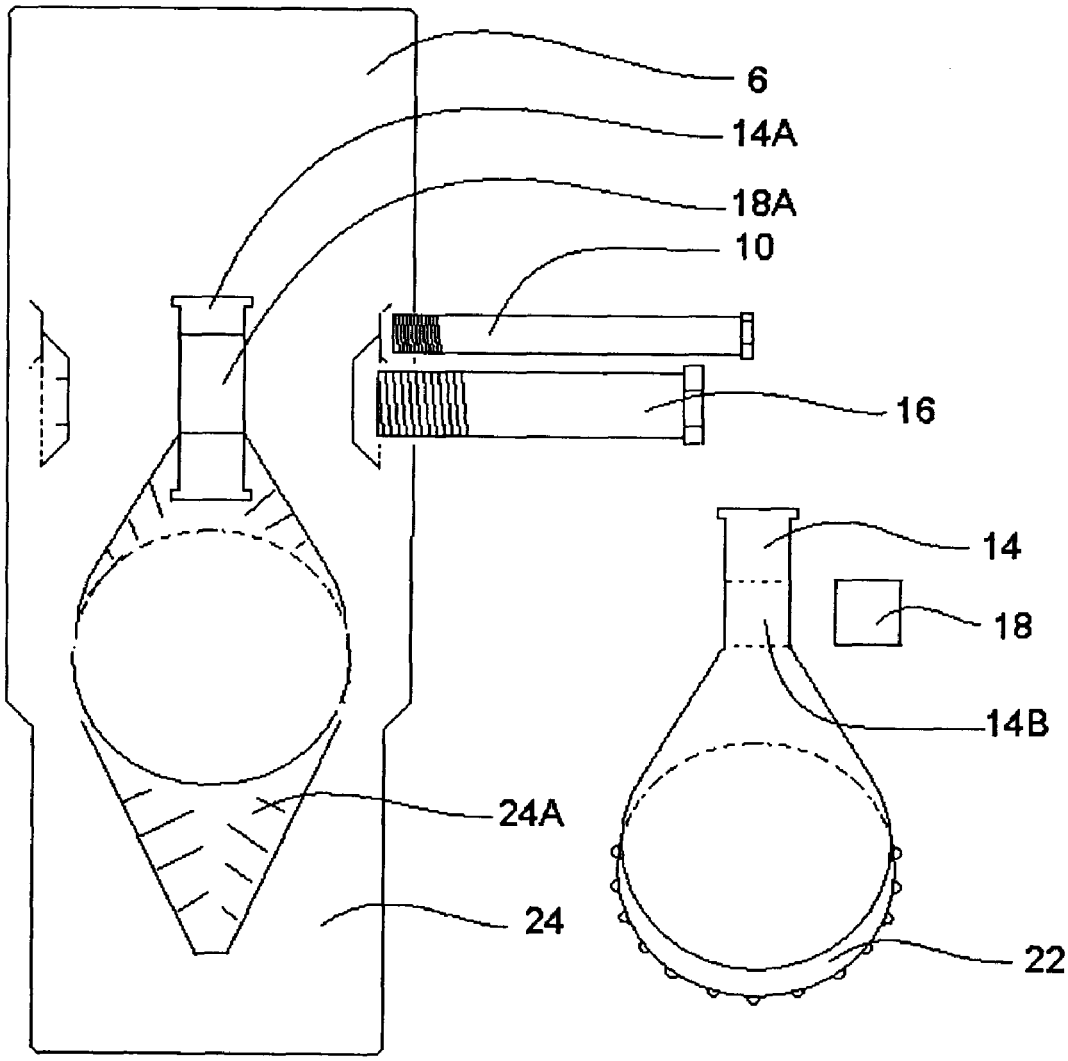
FIG. 2 shows a side vertical section of the underreamer with the stop pin, the swivel pin, the control roller and the cutter cone shown in exploded view.

Referring to FIG. 2, the body of the underreamer includes, for each roller cone, a cavity 24A for receiving the roller cutter 22 and a recess 14A for receiving cone arm 14.

Figure 3:
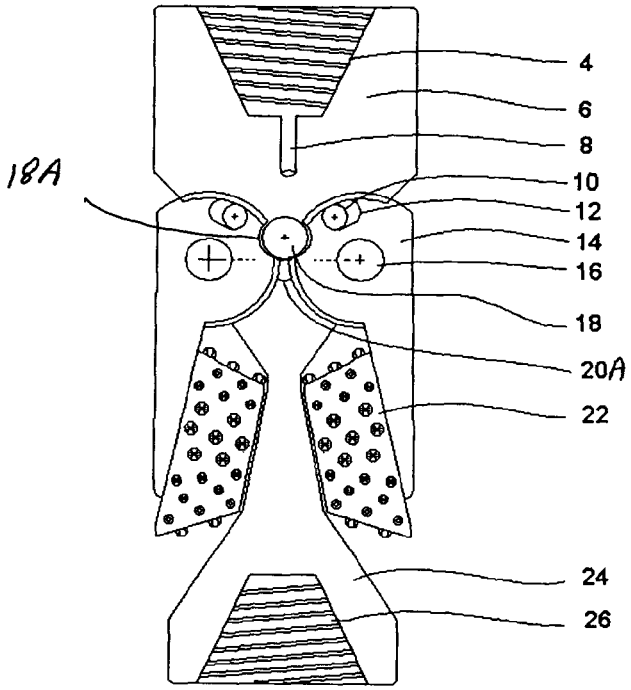
FIG. 3 is a front vertical section showing the cutter cones in the retracted position.
Figure 4:
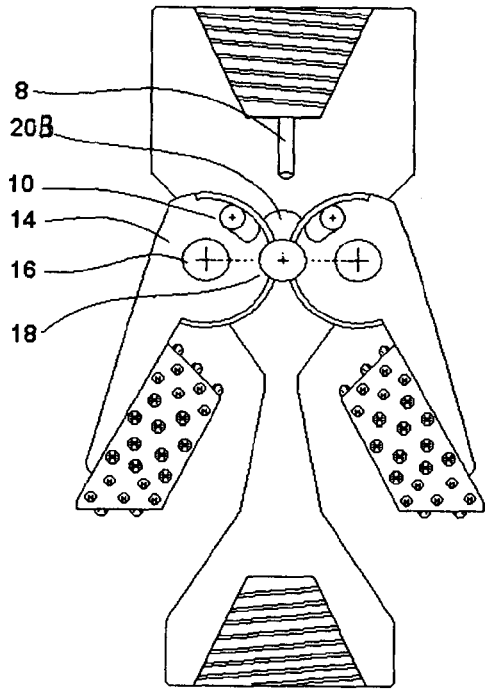
FIG. 4 is a front vertical section showing the cutter cones in the extended position.

A cylindrical linking guide element 18 (seen in side view in FIG. 2) is seated within a guide element opening 18A for ensuring coordinated deployment of the opposed cutter assemblies. The function of the linking guide element 18 is more readily appreciated by reference to FIGS. 3 and 4. Guide element 18 is shared between opposed cone arms 14, each of which is provided with an opening 18A for partially receiving the guide element 18. As the opposed cone arms 14 pivot outward or inward about swivel pins 16, their movement is constrained by the guide element to be in unison. A lower stop seat 20A acts to limit downward movement of the guide element and upper stop seat 20B limits upward movement to thereby limit the displacement of the cone arms. Such displacement is further limited by stop pins 10 that are received in stop pin openings 12 formed in the cone arms.

Figure 5:
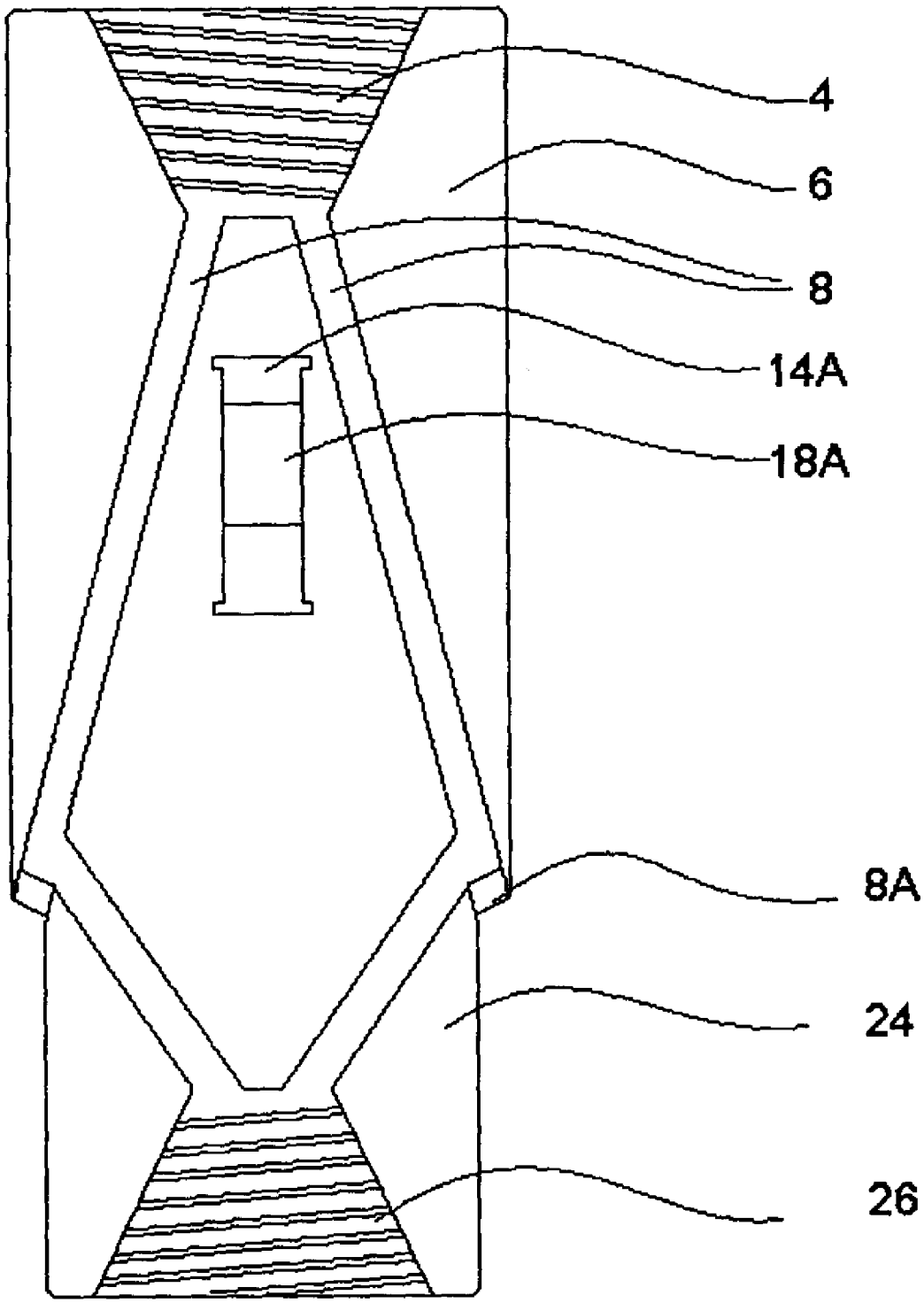
FIG. 5 is a side central vertical section of the underreamer.
Figure 6:
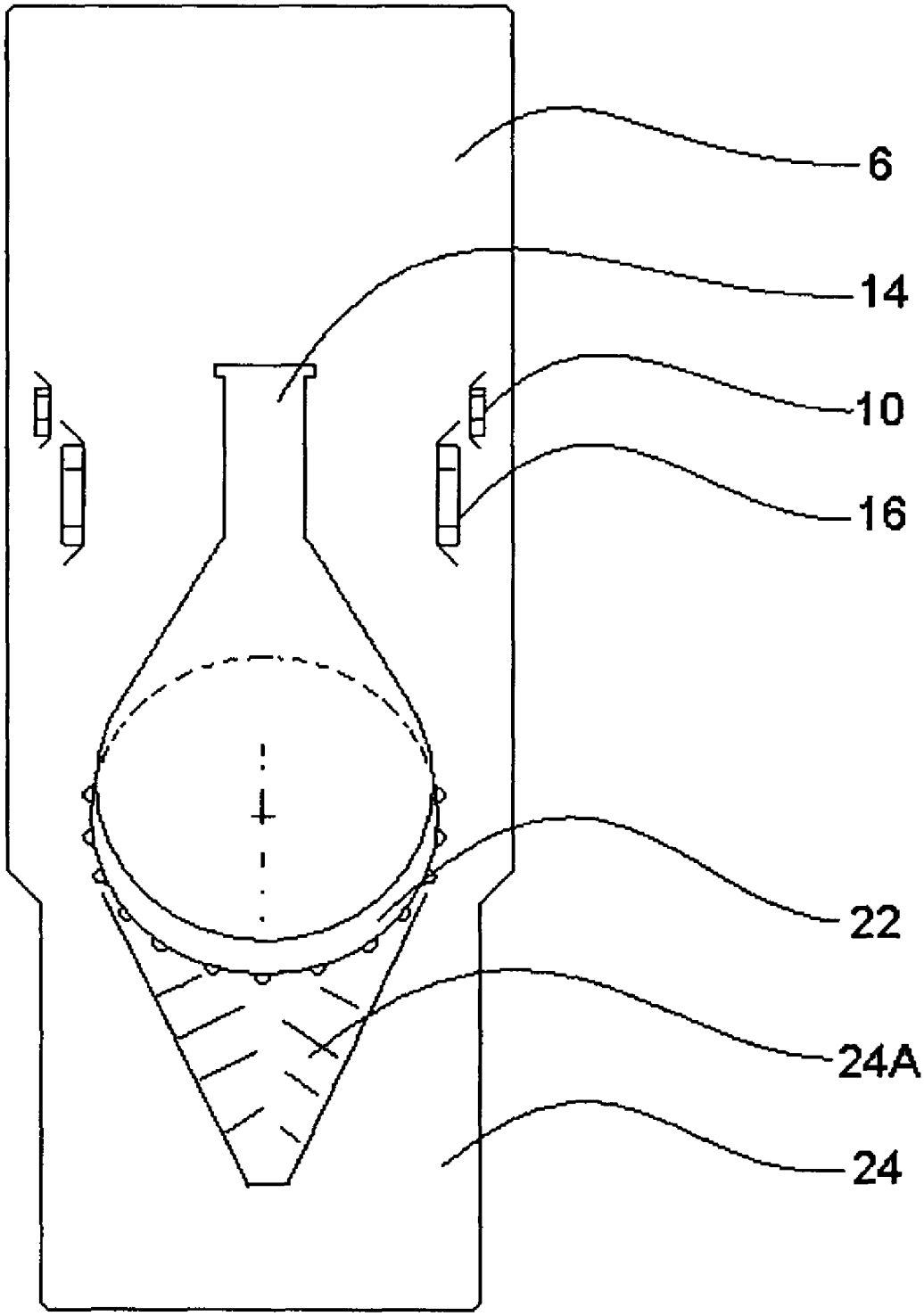
FIG. 6 is a side elevation of the underreamer.
Figure 7:
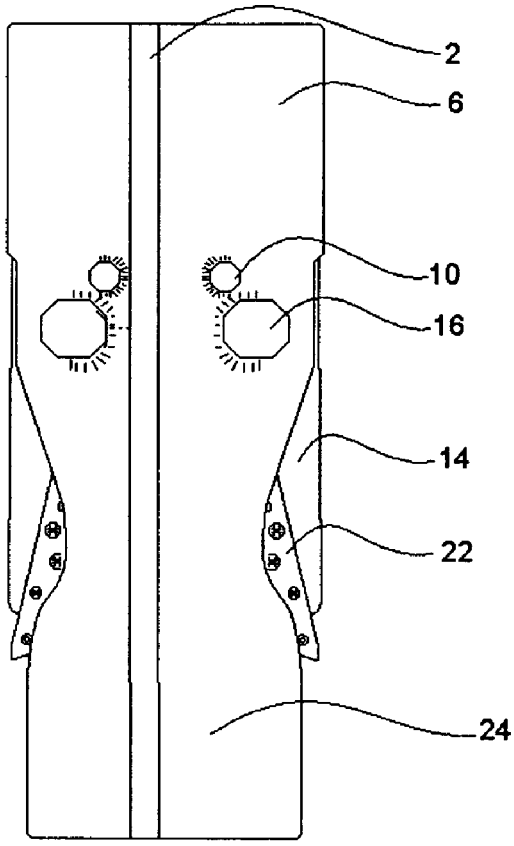
FIG. 7 is a front elevation of the underreamer with the cutter cones in retracted position.
Figure 8:
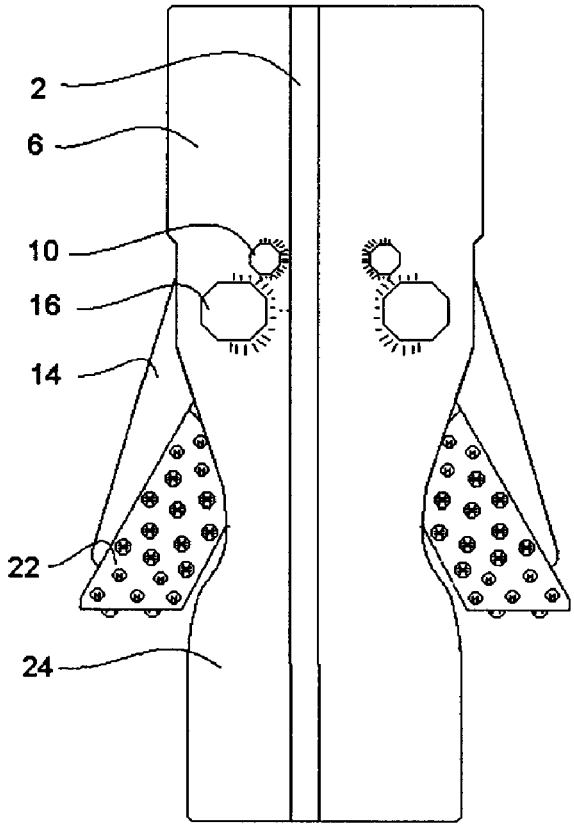
FIG. 8 is a front elevation of the underreamer with the cutter cones in extended position.

FIG. 5 illustrates the configuration of the fluid circulation channels 8 around the cavities containing the cone arms and roller cutters. The cavities themselves are not visible in FIG. 5 as the section is taken along the center of the underreamer and the opposed cavities do not extend to the center. The channels 8 extend from the threads 4 for connection to the drill stem to the threads 26 for connection to the drill bit. The arrangement of the fluid channels around the cutter cavities enables continued drilling even when the underreamer arms are retracted, thereby overcoming a limitation in most prior art underreamers.

Figure 9:
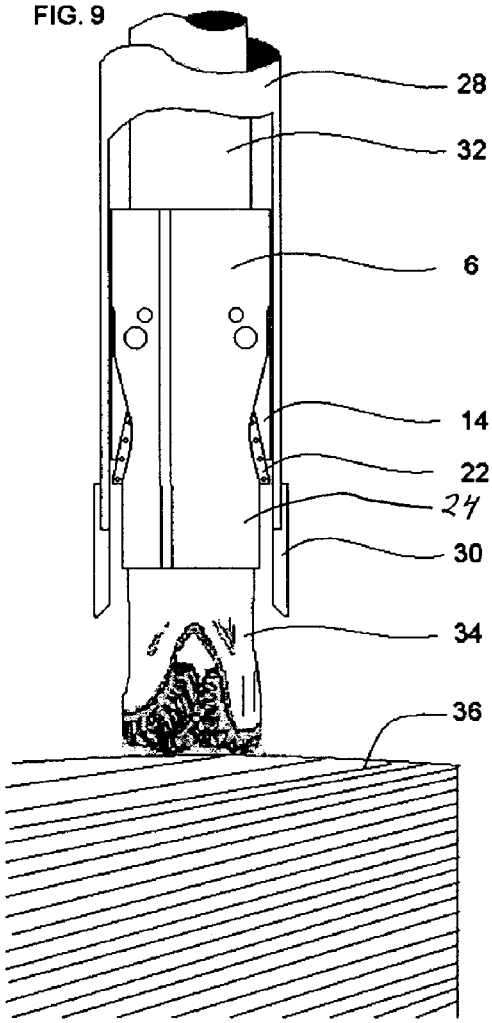
FIG. 9 is a front view showing the underreamer, drill bit and drilling stem, with the underreamer seated inside a section of casing, the casing being shown partially cut away.

FIG. 9 illustrates the underreamer according to the invention as installed in a section of casing 28 downstream of the drill bit 34 and upstream of the drill stem 32. In the preferred embodiment such connection is a threaded connection and when the underreamer is seated therein during normal drilling and casing operation (i.e. before an obstruction is encountered), it is seated so as to remain recessed from the ends of the casing shoe 30.

The upper stabilizer body 6 is of a diameter comparable to the inside diameter of the casing to thereby stabilize the drill stem and drill bit in relation to the casing.

While retained in the casing, the underreamer roller cutters abut the inside edge of the casing to thereby retain the cone arms in their retracted position. In their retracted position, the outermost edges of the roller cutters 22 extend approximately the full extent of the diameter of the upper stabilizer body. Similarly, in the retracted position, the outside faces of the cone arms 14 are flush with the inside surface of the casing 28 and are substantially co-linear with the outside surface of the upper stabilizer body 6.

The lower stabilizer body is made of a diameter smaller than that of the upper stabilizer body and therefore smaller than the lateral extent of the outermost edges of the roller cutters 22. This results in an overlap between the outermost edges of the roller cutters 22 and the lower stabilizer body 24. The diameter of the lower stabilizer body is comparable to the effective diameter of the drill bit 34. This arrangement results in an overlap of the outermost edges of the roller cutters as compared to the diameter of the bore hole created by the drill bit 34.

Figure 10:
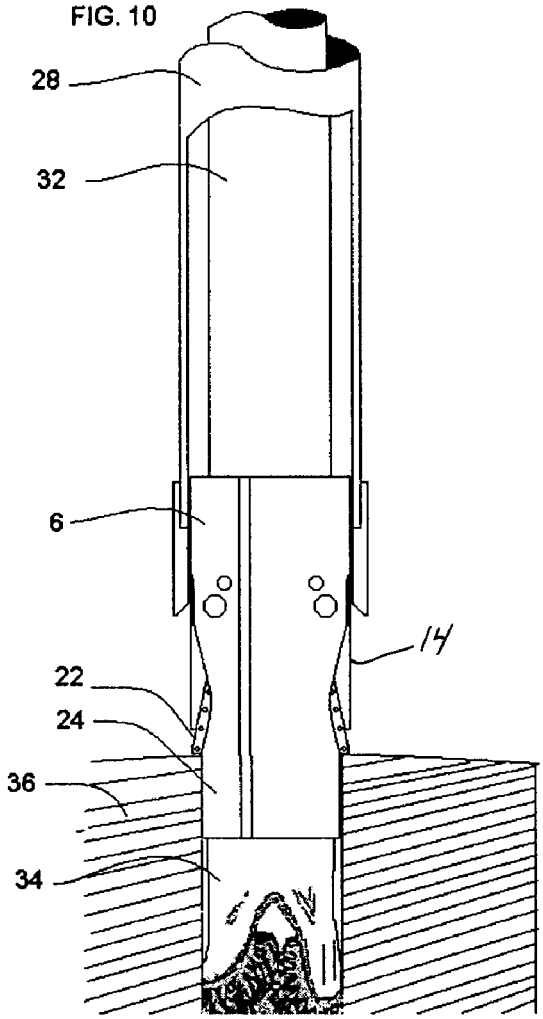
FIG. 10 is a front view showing the drill bit boring into an obstruction and the underreamer extending out of the casing with the roller cutters beginning to contact the edges of the obstruction.

When an obstruction, such as rock 36, is encountered, the operator of the rig disengages the drill stem 32 from casing 28, retains casing 28 in position, and rotates the drill stem 32 to cause the drill bit 34 to drill a pilot hole into the obstruction 36, as shown in FIG. 10. In doing so, the underreamer is also urged downward out of the casing 28.

Figure 11:
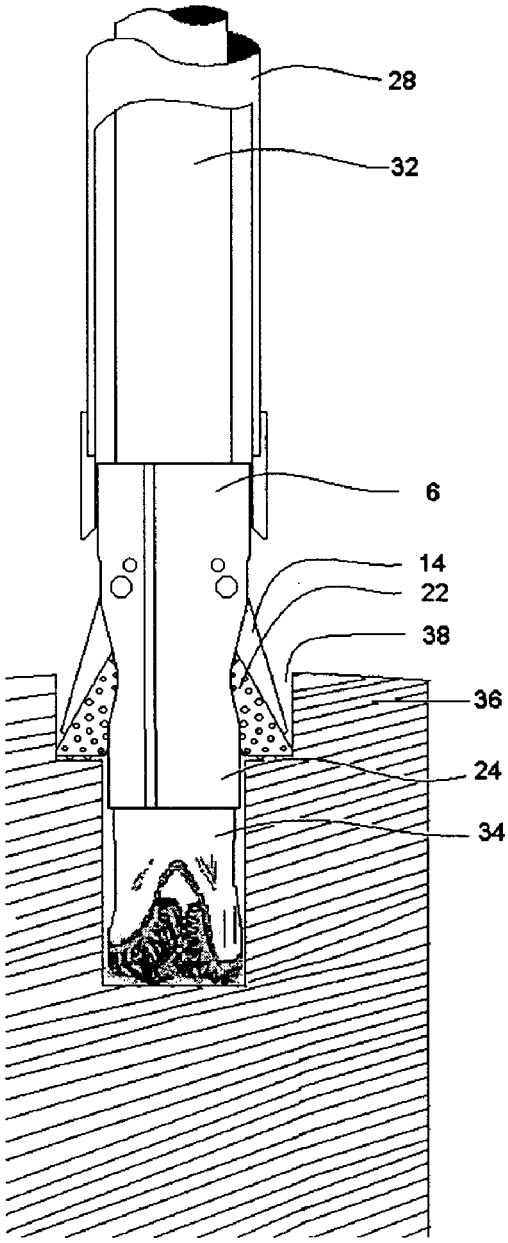
FIG. 11 is a front view showing the underreamer in operation enlarging the diameter of the hole.

Because the outermost edges of the roller cutters 22 overlap the diameter of the pilot hole as discussed above, they engage the edges of the obstruction 36 about the pilot hole. Continued downward pressure from the drill stem causes the cone arms 14 to pivot outward to their extended position as shown in FIG. 11. This is possible because the casing, which has been retained in place while the drill stem, the underreamer and the drill bit have been driven down, no longer retains the cone arms in their retracted position. Drilling proceeds as in FIG. 11 with the underreamer reaming the hole through the obstruction.

Figure 12:
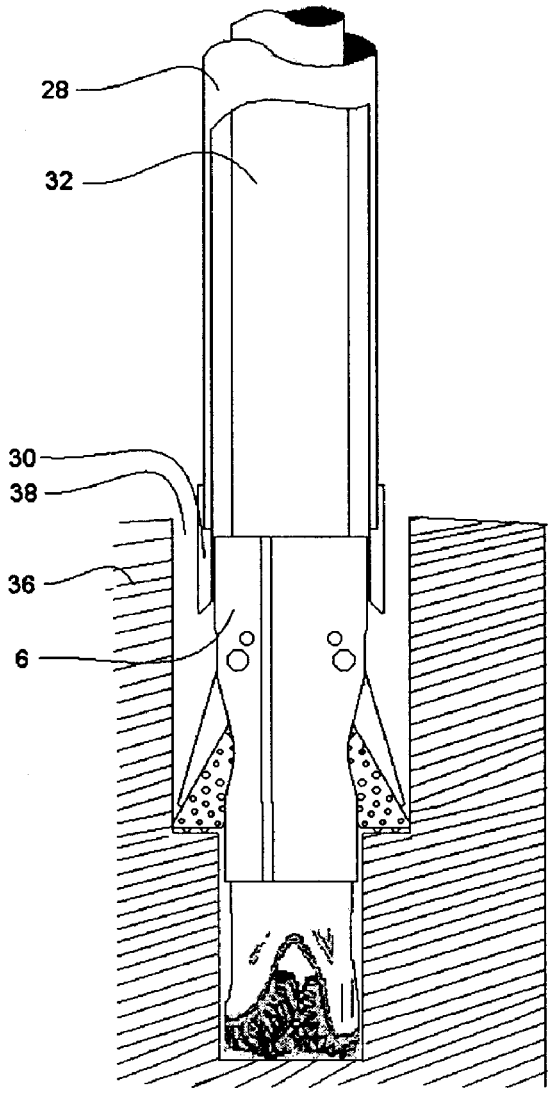
FIG. 12 is a front view showing the casing following the underreamer through the obstruction.

Once the underreamer has been fully deployed, the operator re-engages the casing to the drill stem to continue the drilling and casing operation through the obstruction as shown in FIG. 12.

Once the obstruction has been cleared, or whenever it is desired to retract the roller cutters, the drill stem is disengaged from the casing and the underreamer 1 is withdrawn against and into the casing 28. The abutment of the leading edge of the casing 28 against the cone arms 14 urge the cone arms to pivot back into the retracted position. The operator can then, at his option, reengage the drill stem to the casing with the underreamer in ready position, or can withdraw the underreamer entirely from the casing.

Figure 13:
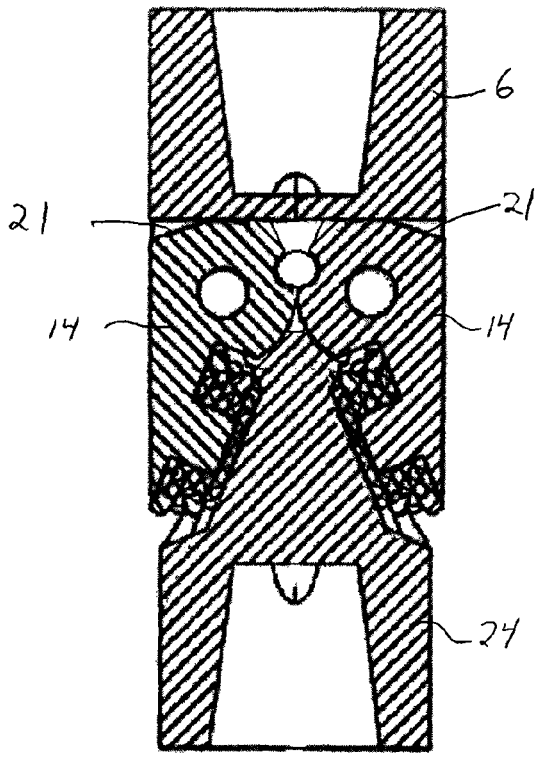
FIG. 13 is a front section of an alternative embodiment of the underreamer in the retracted position; and, FIG. 14 is a front section of the alternative embodiment of the underreamer in the extended position.
Figure 14:
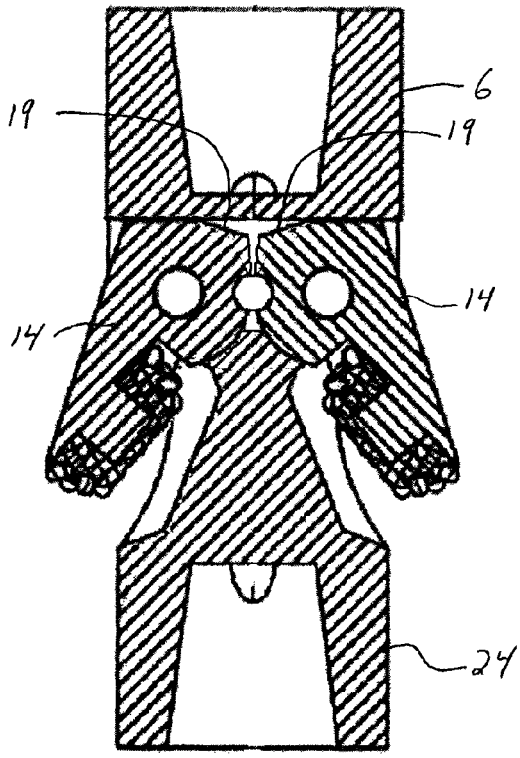

FIGS. 13 and 14 illustrate an alternative embodiment of the underreamer wherein pivotal displacement of the cone arms 14 is limited by means other than the stop pin and control stub seats of the preferred embodiment. As seen in FIG. 14, the interior sides of the uppermost portion of the cone arms 14 are provided with first flat surfaces 19 that abut the underside of upper stabilizer body 6 when the cone arms are in the retracted position as seen in FIG. 13. As seen now in FIG. 13, the exterior sides of the uppermost portion of the cone arms 14 are also provided with second flat surfaces 21 that abut the underside of upper stabilizer body 6 when the cone arms are in the extended position as seen in FIG. 14. In each case, the flat surfaces 19 and 21 abut the upper stabilizer body in face to face relationship thereby providing a stable abutment stop against further displacement of the cone arms.

It will be appreciated by those skilled in the art that other variations to the preferred embodiment described herein may be practised without departing from the scope of the invention, such scope being properly defined by the following claims.

The invention claimed is:

1. An underreamer comprising:

an upper body portion having an upper body diameter;

a lower body portion having a lower body diameter smaller than said upper body diameter;

at least one non-spring-actuated cutter mounted in a cavity for pivotal movement between a retracted position and an extended position; wherein:

in said retracted position, said cutter being defined substantially within said upper body diameter but having an overlap portion thereof extending outside said lower body diameter;

in said extended position, said cutter extending outside said upper body diameter; and wherein pivotal movement of said cutter from said retracted position to said extended position is actuated by urging said overlap portion of said cutter downward against an obstruction.

2. The underreamer of claim 1 wherein said cutter comprises a support arm and a cutting assembly and wherein said cutter is adapted to pivot from said extended position to said retracted position by urging said support arm toward said refracted position.

3. The underreamer of claim 2 wherein said cutter comprises roller cone cutters.

4. The underreamer of claim 2 wherein said cutter comprises at least one blade.

5. The underreamer of claim 2 further comprising threads in said upper body portion for securement of said underreamer to a drill stem and threads in said lower body portion for securement of said underreamer to a drill bit.

6. The underreamer of claim 1 further comprising threads in said upper body portion for securement of said underreamer to a drill stem and threads in said lower body portion for securement of said underreamer to a drill bit.

7. The underreamer of claim 1 further comprising fluid circulation channels providing fluid communication between said upper body portion and said lower body portion, said channels extending around, but not through said cavity.

8. The underreamer assembly of claim 1 further comprising at least one stop pin secured to said upper body portion and extending through an opening associated with said cutter, said stop pin being effective to limit movement of said cutter toward said extended position.

9. The underreamer assembly of claim 1 further comprising a first flat surface on an interior side of an uppermost portion of said cutter, said first flat surface abutting in face to face relationship a flat surface of said upper body portion when said cutter is in said retracted position, and comprising a second flat surface on an exterior side of said uppermost portion, said second flat surface abutting in face to face relationship said flat surface of said upper body portion when said cutter is in said extended position.

10. The underreamer assembly of claim 1 comprising at least two cutter assemblies, each comprising at least one of said cutters, each of said two cutter assemblies being in opposed relation to one another, and comprising means for constraining the two cutter assemblies to pivot in unison.

11. The underreamer assembly of claim 10 wherein said means for constraining the two cutter assemblies to pivot in unison comprises a linking guide element in mating relationship with each of said cutter assemblies.

12. A method of overcoming an obstruction in simultaneous drilling and casing of boreholes using a drill stem, a drill bit and at least one section of casing having a reading end diameter, comprising:

providing an underreamer having at least one non-spring-actuated cutter mounted for pivotal movement between a retracted position and an extended position;

inserting said underreamer into said casing, said casing adapted to contain said cutter in said retracted position by contact with said cutter;

displacing said underreamer in relation to said casing toward said obstruction to at least a point that said cutter exits said casing and is no longer contained by contact with said casing in said refracted position, but is not automatically actuated to pivot to said extended position;

before, after or simultaneous with said previous step, causing said drill bit to drill a pilot hole in said obstruction;

urging said cutter against said obstruction at the edge of said pilot hole whereby said urging causes said cutter to pivot to said extended position outside said leading end diameter; and, using said cutter to ream said pilot hole.

13. The method of claim 12 further comprising causing said cutter to pivot to said retracted position by moving said casing and said underreamer relative to one another such that said cutter withdraws into said casing and contact between said casing and said cutter urges-said cutter into said retracted position.

* * * * *